United States Patent [19]

Lesly

[11] Patent Number: 5,052,324

[45] Date of Patent: Oct. 1, 1991

[54] FOLDING FISHING BOAT APPARATUS

[76] Inventor: Steve Lesly, 126 Elm St., Dumas, Tex. 79029

[21] Appl. No.: 504,919

[22] Filed: Apr. 4, 1990

[51] Int. Cl.[5] ..... B63B 7/00

[52] U.S. Cl. ..... 114/353; 114/61

[58] Field of Search ..... 114/352, 353, 363, 283, 114/343, 61, 123; 224/42.01, 309; D12/311-314, 300, 303, 304

[56] References Cited

U.S. PATENT DOCUMENTS

| | | | |
|---|---|---|---|
| 3,126,558 | 3/1964 | Nolan et al. | 114/352 |
| 3,594,834 | 7/1971 | Steensen | 114/353 |
| 3,642,320 | 2/1972 | Ward | 114/363 |
| 4,366,769 | 1/1983 | Lingeman | 114/352 |
| 4,768,454 | 9/1988 | Selken | 114/353 |

*Primary Examiner*—Ed Swinehart

*Attorney, Agent, or Firm*—Leon Gilden

[57] ABSTRACT

An apparatus is set forth wherein a plurality of spaced pontoons are pivotal relative to one another to define a fishing boat in an open configuration, wherein a brace is selectively positionable within one of a plurality of pairs of spaced recesses aligned with rear and forward portions of the pontoon to receive a trolling motor thereon. A seat is positionable upon a flange member that is fixedly mounted medially of a support member to receive a pedestal base mounting a seat thereon, wherein the pedestal base includes a through-extending opening to receive one of a plurality of rods directed through the member to effect rigidity in the construction of the organization in an open configuration. In a folded configuration, the fishing boat includes latches at exterior terminal ends of the pontoons to latch the pontoons together in a closed configuration.

3 Claims, 4 Drawing Sheets

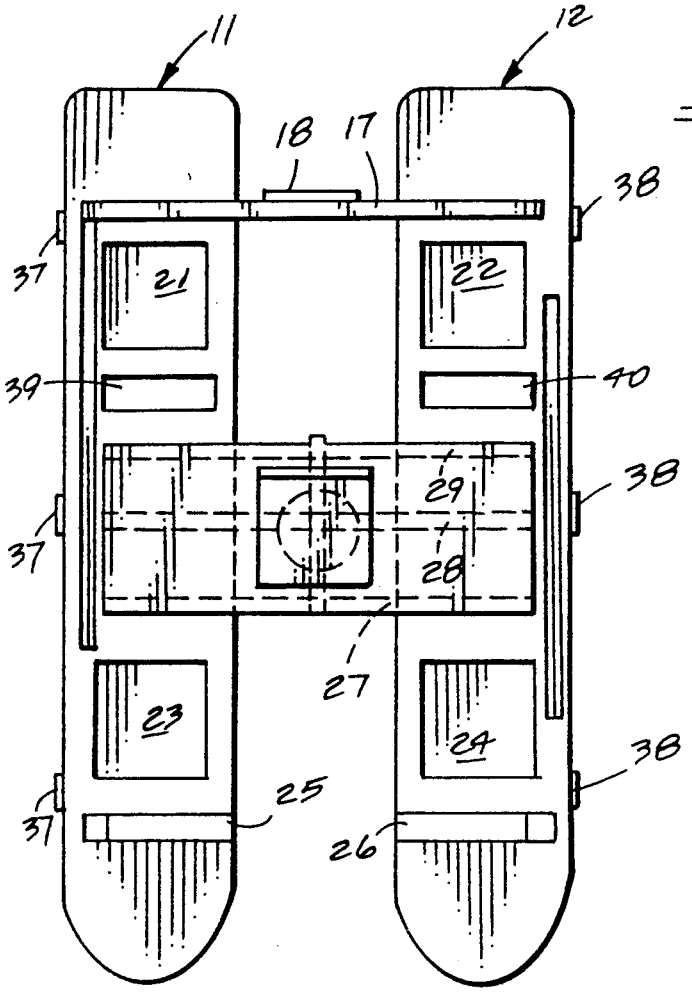
Fig 4
Fig 5
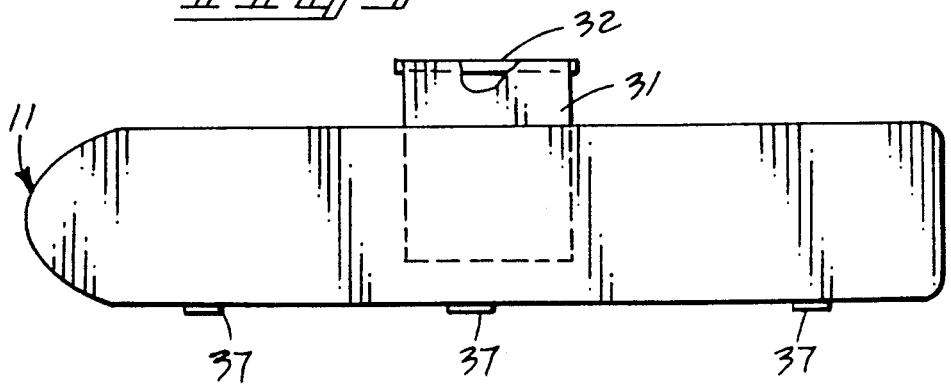

FOLDING FISHING BOAT APPARATUS

BACKGROUND OF THE INVENTION

1. Field of the Invention

The field of invention relates to folding fishing boat arrangements, and more particularly pertains to a new and improved folding fishing boat apparatus wherein the same provides a pontoon fishing boat positionable for fishing within shallow waters, and of a compact configuration to permit ease of storage and portability thereof.

2. Description of the Prior Art

Folding fishing boats have been utilized in the prior art. Contemporary vehicular construction is oriented for a more compact and smaller vehicle and accordingly vehicles to accomodate a fishing boat for convenience of use on surrounding lakes and the like is required to be of a lighter construction in accommodation of the smaller vehicle utilized. The instant invention attempts to overcome deficiencies of the prior art by providing a convient and readily portable organization configured for ease of transport and storage. Examples of the prior art include U.S. Pat. No. 4,841,900 to Maselko wherein a boat is formed in a plurality of watertight sections hingedly connected together folded about their ends to form a car-top carrier.

U.S. Pat. No. 4,233,621 to Berger sets forth a multipontoon sailing craft wherein the pontoons are pivotal relative to a base to permit righting of the vessel whenever it is capsized.

U.S. Pat. No. 4,693,203 to Lewis sets forth a portable boat defined by a plurality of shells pivotally mounted together to define a storage box in an erected configuration.

U.S. Pat. No. 4,736,702 to Gubin sets forth a pontoon type water vessel wherein vehicular wheels are attached to the vessel to permit transoport thereof.

U.S. Pat. No. 4,597,355 to Kirby sets forth a flotation type boat including a central frame member to permit accomodation of various components utilized in the boat. The boat construction is further constructed with a transverse hinge to permit pivotment of the boat itself for transport thereof.

As such, it may be appreciated that there continues to be a need for a new and improved folding fishing boat apparatus wherein the same addresses both the problems of ease of use, as well as effectiveness in construction providing a readily transported and easily erected fishing craft and in this respect, the present invention susbstantially fulfills this need.

SUMMARY OF THE INVENITON

In view of the foregoing disadvantages inherent in the known types of foldable fishing craft now present in the prior art, the present invention provides a folding fishing boat apparatus wherein the same provides a pontoon fishing boat that is readily foldable about its longitudinal axis to permit transport and storage thereof. As such, the general purpose of the present invention, which will be described susbsequently in greater detail, is to provide a new and improved folding fishing boat apparatus which has all the advantages of the prior art foldable fishing craft and none of the disadvantages.

To attain this, the present invention provides an apparatus wherein a plurality of spaced pontoons are pivotal relative to one another to define a fishing boat in an open configuration, wherein a brace is positionable within spaced recesses aligned with rear portions of the pontoon to receive a trolling motor thereon and the like. A seat is positionable upon a flange member that is fixedly mounted medially of the member to received a pedestal base mounting a seat thereon, wherein the pedestal base includes a through-extending opening to receive one of a plurality of rods directed through the member to effect rigidity in the construction of the orgainization in an open configuration. In a folded orientation, the fishing boat includes latches at exterior terminal ends of the pontoons to latch the pontoons together in a closed configuration.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described herinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstruct is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved folding fishing boat apparatus which has all the advantages of the prior art folding boat craft and none of the disadvantages.

It is another object of the present invention to provide a new and improved folding fishing boat apparatus which may be easily and efficiently manufactured and marketed.

It is a further object of the present invention to provide a new and improved folding fishing boat apparatus which is of a durable and reliable construction.

An even further object of the present invention is to provide a new and improved folding fishing boat apparatus which is susceptible of a low cost of manufacture with regard to both materials and labor, and which accordingly is then susceptible of low prices of sale to the consuming public, thereby making such folding fishing boat apparatus economically available to the buying public.

Still yet another object of the present invention is to provide a new and improved folding fishing boat apparatus which provides in the apparatuses and methods of the prior art some of the advantages thereof, while simultaneously overcoming some of the disadvantages normally associated therewith.

Still another object of the present invention is to provide a new and improved folding fishing boat apparatus wherein the same includes a plurality of spaced pontoons and seat structure mounted between the pontoons, wherein the organization is readily disassembled into a conviently transported organization subsequent to use.

These together with other objects of the invention, along with the various features of novelty which characterize the invention, are pointed output with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is a top orthographic view of the instant invention.

FIG. 5 is an orthographic side view, taken in elevation, of the organization in a folded configuration.

DESCRIPTION OF THE PREFERRED EMBODIMENT

Figure 1:
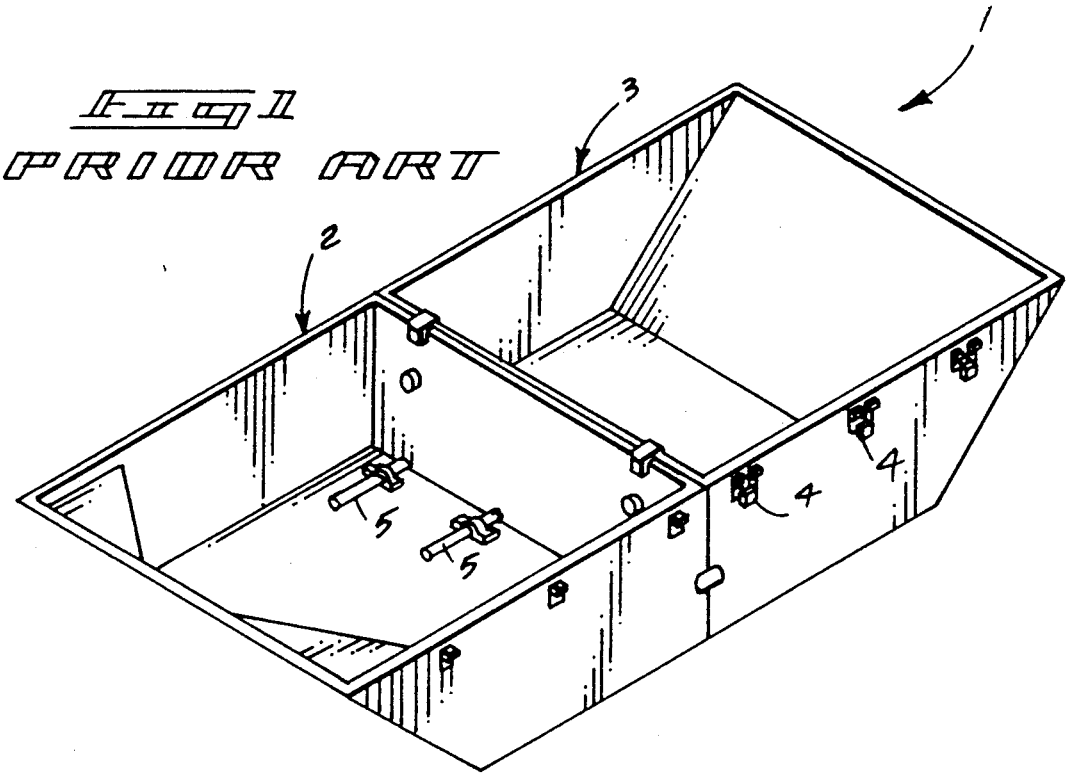
FIG 1 PRIOR ART
FIG. 1 is an isometric illustration of a prior art fishing boat apparatus.

With reference now to the drawings, and in particular to FIGS. 1 to 7 thereof, a new and improved folding fishing boat apparatus embodying the priciples and concepts of the present invention and generally designated by the reference numeral 10 will be described.

Figure 2:
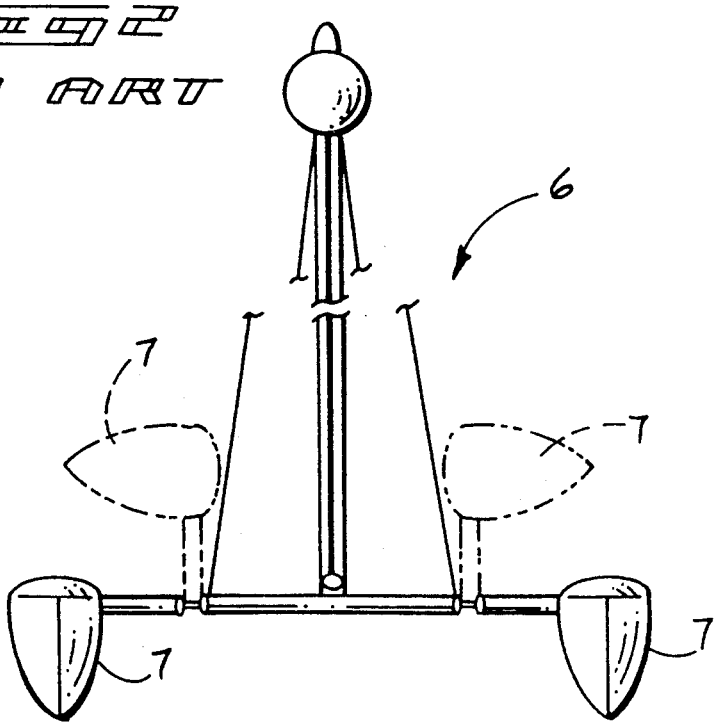
FIG 2 PRIOR ART
FIG. 2 is an orthographic end view, taken in elevation, of a pontoon type water craft developed in the prior art.
Figure 2:
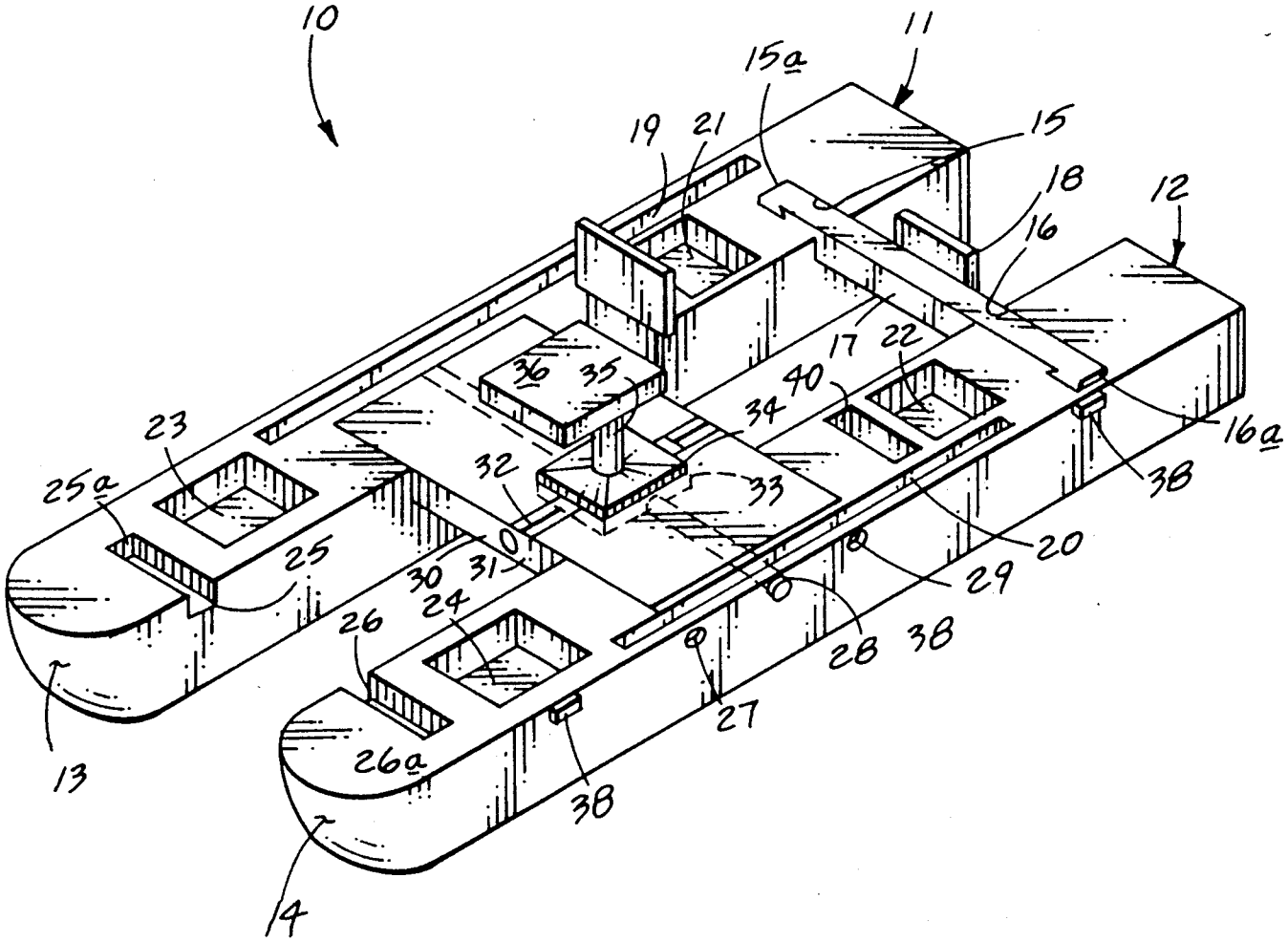
Figure 6:
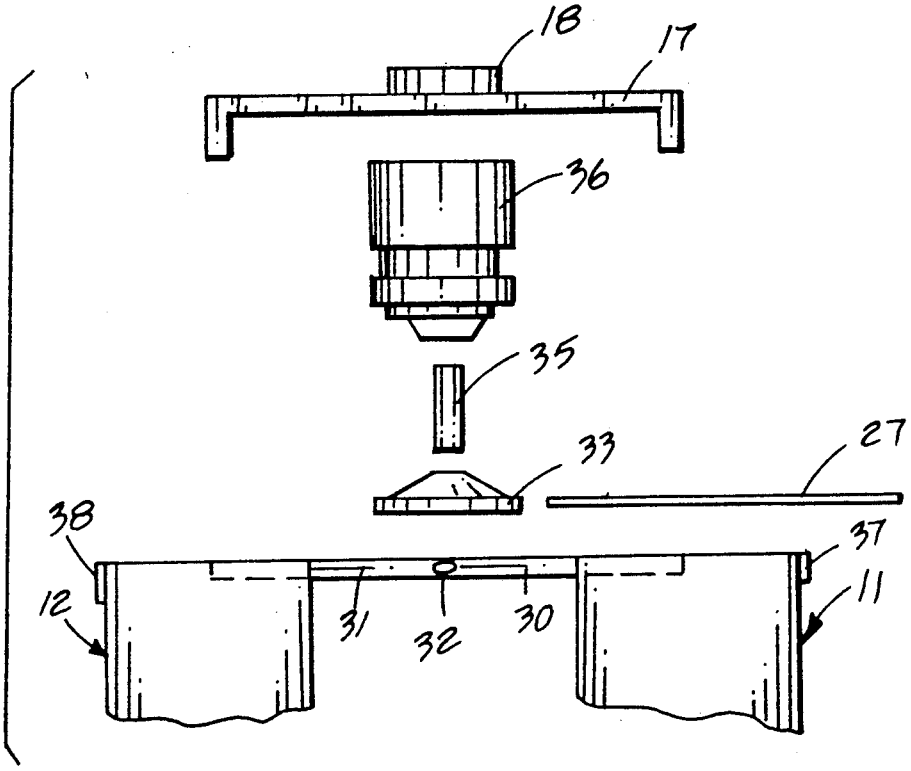
FIG. 6 is an orthographic view, somewhat exploded, of the instant invention in an end view illustration.

FIG. 1 illustrates a prior art foldable fishing boat type structure 1, wherein a first and second respective spaced shell 2 and 3 are logitudinally aligned relative to one another and hingedly mounted in an end-to-end relationship, as illustrated. A series of clamps 4 are cooperatively arranged within each shell to secure the shells in an overfolded relationship to permit use of the organization as a cartop carrier. Rod members 5 extend through each of the shells to rigidly secure the shells in an extended configuration. FIG. 2 illustrates a further prior art sailing craft 6, wherein pontoons 7 are pivotal about a base to permit righting of the craft in the event of capsizing.

More specifically, the folding fishing boat apparatus 10 of the instant invention essentially comprises a first elongate logitudinally aligned pontoon 11 spaced from and parallel to an adjacent second longitudinally aligned pontoon 12. The pontoon construction is formed of an APS polymeric, or alternatively of fiberglass. Further, it is desirable that the pontoons be for a foam-filled construction to enhance flotation in of the organization.

The pontoons 11 and 12 are defined by a respective first and second arcuate nose 13 and 14 formed on forwardmost ends thereof. The first pontoon 11 includes a first brace recess 15 formed orthogonally within the pontoon from an interior side wall thereof adjacent its rear terminal end and aligned with a second brace recess 16 formed through the top surface of the second pontoon 12 and directed through an interior side wall thereof. The respective recesses 15 and 16 include respective ends defined by a first recess end **15*a* and a second recess end 16*a* spaced apart by a predetermined spacing. An elongate brace 17 of a length equal to the predetermined spacing is positionable within the opposed brace recesses 15 and 16 when the fishing boat apparatus is in an extended or opened configuration, as illustrated in FIG. 3. The elongate brace 17 includes a mounting flange 18 integrally mounted to a rear surface of the elongate brace 17 for securement of a trolling motor (not shown) thereon. The pontoons 11 and 12 further include a third and fourth brace recess 25 and 26 arranged in aligned relationship relative to one another of a similar configuration to that of the first and second brace recesses 15 and 16, wherein the third and fourth brace recesses 25 and 26 are formed with third and fourth ends 25*a* and 26*a* spaced apart the predetermined spacing. Accordingly, the third and fourth brace recesses may also accommodate the elongate brace 17 selectively therewithin in the event an individual requires a forward mounting of a trolling motor to a forwardmost end of the boat apparatus 10. The elongate brace 17 is defined by a generally parallelepiped configuration, wherein each of the brace recesses 15, 16, 25, and 26 are each of a cross-sectional configuration substantially equal to that defined by the elongate brace 17**.

A first elongate pontoon recess 19 is longitudinally aligned through a top surface of the first pontoon 11, wherein a second pontoon recess 20 is longitudinally aligned with and formed through a top surface of a second pontoon 12. The first pontoon recess 19 accommodates the elongate brace 17 therewithin in a complementary configuration. It is noted (see FIG. 6) that the elongate brace is of a generally "U" shaped configuration, with the legs received within opposed terminal ends of the first pontoon recess 19, wherein the first, second, third, and fourth brace recesses 15, 16, 25, and 26 are also of a generally "L" shaped configuration to accommodate each of the legs of the "U" shaped elongate brace. The "U" shaped elongate brace 17 resists a torquing of the brace, or twisting thereof, relative to its associated positioning within the aligned pairs of respective recesses with use of a trolling motor therewith.

Figure 7:
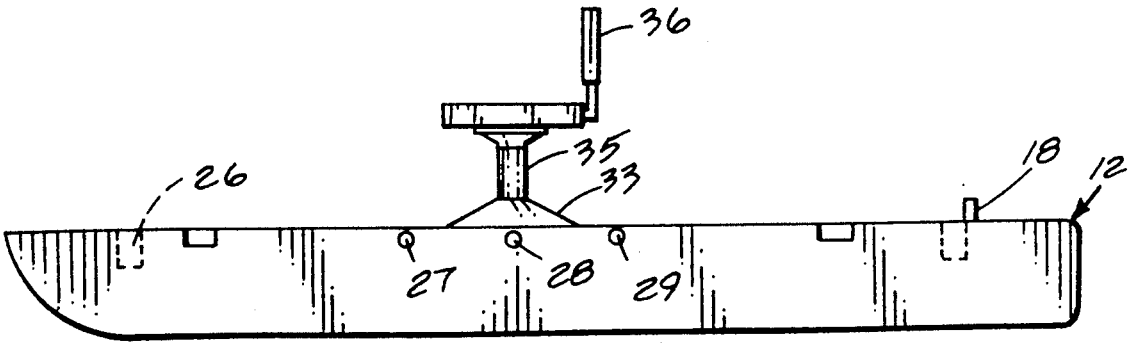
FIG. 7 is an orthographic side view, taken in elevation, of the instant invention.

The second pontoon recess 20 accommodates a series of first, second, and third respective rods 27, 28, and 29. The rods are received within associated elongate cylindrical openings directed from an exterior side wall of the second pontoon 12, as illustrated in FIGS. 3, 4, and 7. The pontoons, as it will be understood from a description below, maintain the organization in an open configuration when positioned within the respective cylindrical openings. A first folding plate 30 is rigidly mounted orthogonally to an interior wall of the first pontoon 11 and is in confronting relationship to a second folding plate 31 orthogonally and integrally mounted to an interior wall of the second pontoon 12. The first and second plates are hingedly mounted relative to one another by use of a coextensive hinge 32 mounted medially thereof. A plate recess 33 is formed between the two folding plates medially thereof to accommodate a pedestal plate 34, a pedestal 35 and a seat 36 slidably mounted on the pedestal 35 when in an erected configuration. The pedestal plate 34 includes a cylindrical opening aligned with a central cylindrical opening formed through the pontoon 12 and the first and second plates 30 and 31 to receive the second base rod 28 therethrough. The first and third base rods 27 and 29 are also directed through the first and second folding plates 30 and 31 to maintain them in an aligned planar configuration relative to one another. When the associated pedestal plate 34 and seat structure are removed and the rods 27, 28, and 29 are removed, the organization permits folding of the first plate relative to the second plate upon removal of the elongate brace 17 into a configuration, as illustrated in FIG. 5 for example, with the hinge 32 forming a grasp rail to permit portability of the organization. A series of first and second latches 37 and 38 are mounted on respective opposed sides of the first and second pontoons 11 and 12 to engage relative to one another to secure the pontoons in a folding configuration.

The pontoons 11 and 12 include a series of recesses therewithin, including a first pedestral base recess 21 formed to a top surface of the first pontoon 11, with a corresponding pedestal base recess 22 formed within the second pontoon 12 through a top surface thereof. A third pedestal base recess 23 is formed through the top surface of the first pontoon 11 forwardly of the first folding plate 30, with a fourth pedestal base recess 24 formed through the top surface of the second pontoon 12. A fifth recess 39 is formed between the first plate 30 and the first recess 21, with a sixth recess 40 formed rearwardly of the second plate 31 forwardly of the second recess 22. The recesses 21, 22, 23, 24, 39, and 40 are of equal depth to accommodate the seat and pedestal structure 36, 35, and 34. The pedestal plate 34, for example, is mounted within the first recess 21, wherein the recess 21 and the associated second recess 22 are each of a depth substantially half of that of the pedestal plate 34 to envelope the base when the pontoons 11 and 12 are in a collapsed configuration in confronting relationship relative to one another. The fifth and sixth recesses 39 and 40 are each of a configuration substantially accommodating one-half the depth of the pedestal 35 to envelope the pedestal 35 in an overfolded relationship of the first pontoon relative to the second pontoon 11. Finally, the spaced and aligned recesses 23 and 24 are each of a configuration to receive one-half the defined volume of the seat 36 to permit enveloping of the seat when the pontoons 11 and 12 are in a face-to-face relationship. To enhance positioning of the seat 36 within the third and fourth recesses 23 and 24, the seat 36 may optionally be overfolded relative to itself into a compact structure or the recesses may be of a generally "L" shaped configuration to accommodate the seat 36 therewithin.

It is understood that the folding fishing boat apparatus 10 of the instant invention therefore provides a compact, readily portable organization when in an opened and erected configuration, as illustrated. Typical dimensional configurations of the boat apparatus may include pontoons of a generally eight foot length and of approximately eighteen inches in width. The pontoons are typically spaced apart sixteen inches to two feet to provide a compact rigid structure when the first and second plates 30 and 31 are in an extended locked configuration relative to one another, with the rods 27, 28, and 29 directed therethrough.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A folding fishing boat apparatus comprising, in combination, a first elongate longitudinally aligned pontoon including a first folding plate orthogonally mounted to the first pontoon, and a second pontoon longitudinally aligned and arranged parallel to the first pontoon, with the second pontoon including a second folding plate orthogonally and integrally mounted to the second pontoon, wherein the first folding plate and second folding plate are pivotally mounted relative to one another, by hinge means, and said hinge means securing the first and second plate together for permitting a spaced relationship of the first and second pontoons in a first position and enabling pivoting of the first and second pontoons relative to one another to permit a contiguous relationship of the first and second pontoons relative to one another in a second position, and first latch means mounted on the first pontoon and second latch means mounted on the second pontoon for securement to the first latch means to secure the first and second pontoons in the second position, and wherein the first pontoon includes a first brace recess and the second pontoon includes a second brace recess, wherein the first and second brace recesses are in aligned relationship relative to one another, and an elongate "U" shaped brace receivable within the first and second brace recesses when the first and second pontoons are in the first position, and including a third brace recess formed adjacent a forward end of the first pontoon and a fourth brace recess positioned adjacent a forward end of the second pontoon, wherein the third and fourth brace recesses are aligned relative to one another adapted to received the elongate "U" shaped brace therewithin, and the first and second brace recesses are positioned within the first and second pontoons respectively adjacent rear terminal ends of the respective first and second pontoons, and wherein each of the brace recesses are arranged orthogonally to a longitudinal axis defined by each first and second pontoon, and wherein the first and second folding plates each include cylindrical bores and when the first and second pontoons are in the first position, the bores of said first and second are aligned to receive a respective rigid rod therewithin to maintain the first and second pontoons in the first position.

2. An apparatus as set forth in claim 1 wherein the first and second folding plates each includes a pedestal recess therewithin, and further including a pedestal positionable within the pedestal recess, and the pedestal including a pedestal bore to receive one of said rigid rods therethrough, and the pedestal includes a pedestal support orthogonally mounted to the pedestal and a seat mounted to the pedestal support, the seat, the pedestal support, and the pedestal are selectively securable relative to one another.

3. An apparatus as set forth in claim 2 wherein the first pontoon includes a first, second, and third recess, and the second pontoon includes a fourth, fifth, and sixth recess, wherein the first and fourth recess are aligned relative to one another, the second and fifth recess are aligned relative to one another, and the third and sixth recess are aligned relative to one another when the first and second pontoons are in the second position.

* * * * *